US008084964B2

(12) United States Patent
Hsiao et al.

(10) Patent No.: US 8,084,964 B2
(45) Date of Patent: Dec. 27, 2011

(54) METHODS FOR ADJUSTING BRIGHTNESS OF LIGHT SOURCES

(75) Inventors: En-Hsun Hsiao, Taipei County (TW); Chin-Yen Huang, Taipei County (TW)

(73) Assignee: Princeton Technology Corporation, Taipei County (TW)

( * ) Notice: Subject to any disclaimer, the term of this patent is extended or adjusted under 35 U.S.C. 154(b) by 425 days.

(21) Appl. No.: 12/491,327

(22) Filed: Jun. 25, 2009

(65) Prior Publication Data

US 2010/0039050 A1 Feb. 18, 2010

(30) Foreign Application Priority Data

Aug. 12, 2008 (TW) ..... 97130656 A

(51) Int. Cl.
*H05B 37/02* (2006.01)

(52) U.S. Cl. ..... 315/362; 315/307; 700/12

(58) Field of Classification Search ..... 315/209 R, 315/210, 291, 297, 307, 362; 700/11–14
See application file for complete search history.

(56) References Cited

U.S. PATENT DOCUMENTS

| | | | | |
|---|---|---|---|---|
| 6,040,660 | A | 3/2000 | Schmidt et al. | |
| 2001/0007394 | A1 * | 7/2001 | Beaver | 296/97.9 |
| 2006/0116178 | A1 * | 6/2006 | Vuong et al. | 455/574 |
| 2007/0097065 | A1 * | 5/2007 | Kreek et al. | 345/102 |
| 2010/0146461 | A1 * | 6/2010 | Ryu et al. | 715/863 |
| 2011/0156923 | A1 * | 6/2011 | Van Endert | 340/815.4 |
| 2011/0215730 | A1 * | 9/2011 | Duffy et al. | 315/250 |

FOREIGN PATENT DOCUMENTS

EP 1725085 A1 11/2006

* cited by examiner

*Primary Examiner* — Don Le
(74) *Attorney, Agent, or Firm* — Muncy, Geissler, Olds & Lowe, PLLC

(57) ABSTRACT

A method for adjusting brightness of a light source is provided. A light source with X brightness degrees is provided. The light source is turned on and off at least one time. When the number n of times of turning on the light source is less than or equal to the total number X of brightness degrees, the brightness degree of the light source is determined to be the $n^{th}$ brightness degree. When the number n is greater than the total number X, the brightness degree of the light source is determined to be the $m^{th}$ brightness degree, wherein the number m is equal to a remainder obtained by dividing the number n by the number X, is determined; if the number m is equal to zero, the brightness degree of the light source is determined to be the last brightness degree.

9 Claims, 2 Drawing Sheets

METHODS FOR ADJUSTING BRIGHTNESS OF LIGHT SOURCES

CROSS REFERENCE TO RELATED APPLICATIONS

This application claims the benefit of Taiwan application Serial No. 097130656 filed Aug. 12, 2008, the subject matter of which is incorporated herein by reference.

BACKGROUND OF THE INVENTION

1. Field of the Invention

The invention relates to a method for adjusting brightness of a light source, and more particularly to a method for adjusting brightness of a light source by turning on and off the light source.

2. Description of the Related Art

When conventional illumination devices, such as white lamps, fluorescent lamps, and light emitting diodes, are lit, they provide light sources with fixed brightness. In some conditions where high brightness is not required, energy is wasted by the superfluous brightness provided by the illumination devices. Additionally, it is often inconvenient for users to change brightness of the illumination devices to provide appropriate brightness according to surrounding environment conditions. Thus, appropriate brightness is an important issue for illumination devices.

BRIEF SUMMARY OF THE INVENTION

An exemplary embodiment of a method for adjusting brightness of a light source is provided. The method comprises: providing a light source with X brightness degrees; turning on and off the light source at least one time; when the number n of times of turning on the light source is less than or equal to the total number X of brightness degrees, determining the brightness degree of the light source being the $n^{th}$ brightness degree among the X brightness degrees; when the number n of times of turning on the light source is greater than the total number X of brightness degrees, determining the brightness degree of the light source being the $m^{th}$ brightness degree among the X brightness degrees, wherein the number m is equal to a remainder obtained by dividing the number n by the number X; and when the number n of times of turning on the light source is greater than the total number X of brightness degrees and the number m is equal to zero, determining the brightness degree of the light source being the last brightness degree among the X brightness degrees.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
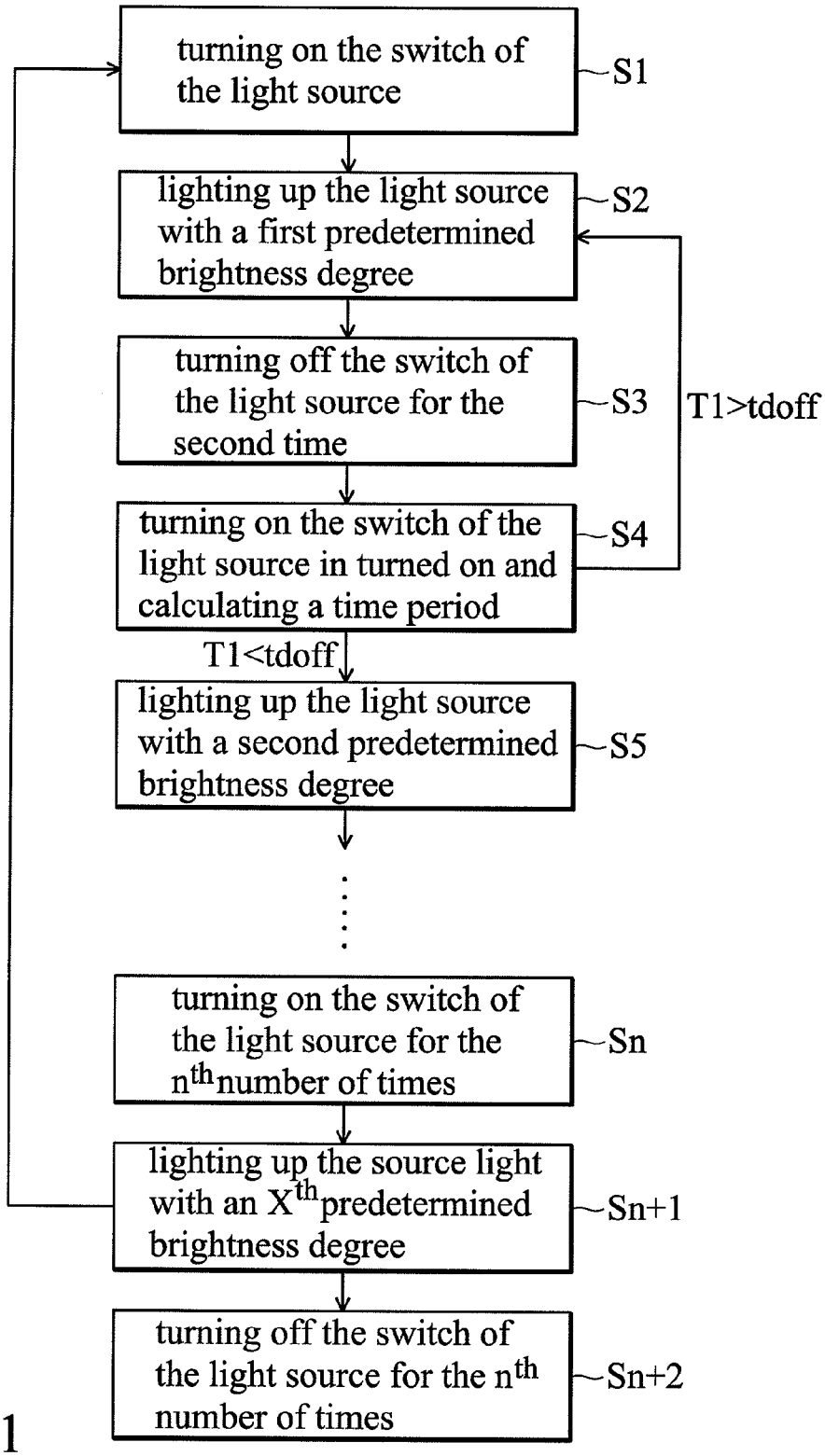
FIG. 1 is a flow chart of an exemplary embodiment of a method for adjusting brightness of a light source with a plurality of brightness degrees.

FIG. 1 is a flow chart of an exemplary embodiment of a method for adjusting brightness of a light source with a plurality of brightness degrees. The number of brightness degrees of the light source is represented by X. In the embodiment, a switch of the light source is first turned on (step S1). At this time, the light source is lit up with a first predetermined brightness degree (step S2), wherein the first predetermined brightness is usually the brightest or darkest, however, without limitation. Then, the switch of the light source is turned off (step S3). After the switch of the light source is turned off, the switch of the light source is turned on for a second time (step S4), and a time period T1 (i.e. a light source turned-on period) from the last time point when the switch of the light source is turned off to the time point when the last time the switch thereof is turned on is calculated. If the time period T1 is longer than a predetermined period tdoff, the method returns to the step S2. That is, the light source is lit with the first predetermined brightness degree. If the time period T1 is shorter than the predetermined period tdoff, the light source is lit with a second predetermined brightness degree (step S5). In the embodiment, the predetermined period tdoff can be set arbitrarily, and the second predetermined brightness degree is usually different from the first predetermined brightness degree, however, without limitation.

If the switch of the light source is turned off and then turned on again, a time period T2 from the last time point when the switch of the light source is turned off to the last time point when the switch thereof is turned on is calculated. The time period T2 is compared with the predetermined period tdoff to determine whether the time period T2 is longer than the predetermined period tdoff. If the time period T2 is longer than the predetermined period tdoff, the method returns to the step S1, and the light source is lit with the first predetermined brightness degree. If the time period T2 is shorter than the predetermined period tdoff, the light source is lit with a third predetermined brightness degree.

By repeating the above steps, when each calculated time period from the last time point when the switch of the light source is turned off to the last time point when the switch thereof is turned on is shorter than the predetermined period tdoff, the light source is each lit with different brightness degrees according to the number of times of turning on and off the switch of the light source. The number X of brightness degrees is determined according to the number of times of turning on and off the switch of the light source. That is, in the prerequisite of that when each calculated time period T (i.e. a light source turned-on period) from the last time point when the switch of the light source is turned off to the last time point when the switch thereof is turned on is shorter than the predetermined period tdoff, the number X of brightness degrees is determined according to the times of turning on and off the switch of the light source.

Following examples may be deduced, and the switch of the light source can be turned on for an $n^{th}$ number of times. At this time, n is equal to the number X of brightness degrees. When the switch of the light source is turned on for an $n^{th}$ number of times (step Sn), the source light is lit up with an $X^{th}$ predetermined brightness degree (step Sn+1). When the method performs the step Sn+1, all of the predetermined brightness degrees have been used to light the light source. If the switch of the light source is turned off at the $n^{th}$ number of times in the step Sn+2 and then turned on at the $n+1^{th}$ number of times, there is no brightness degree for the $n+1^{th}$ number of times of turning on the switch of the light source because there are only X brightness degrees. In the case, the light source is lit with the first predetermined brightness degree. That is, the first predetermined brightness degree is determined for the $n+1^{th}$ number of times of turning on the switch of the light source.

According to the above description, when the number n of times of turning on the switch of the light source is less than or equal to the number X of total brightness degrees for lighting up the light source (n<X), the light source is lit up with the $n^{th}$ predetermined brightness degree. When n>X, the light source is lit up with the $m^{th}$ predetermined brightness degree, wherein m is equal to the remainder obtained by dividing n by X. If the remainder obtained by dividing n by X is equal to zero, the light source is lit up with the $X^{th}$ predetermined brightness degree.

For example, it is assumed that the number X of brightness degrees for lighting up the light source is equal to 5. When the number n of times of turning on the switch of the light source is equal to 4, the light source is lit up with the $4^{th}$ predetermined brightness degree due to 4<5. When the number n of times of turning on the switch of the light source is equal to 13, the light source is lit up with the $3^{th}$ predetermined brightness degree due to 13<5, wherein 3 is equal to the remainder obtained by dividing 13 by 5 (13÷5=2 . . . 3). When the number n of times of turning on the switch of the light source is equal to 10, the light source is lit up with the $5^{th}$ predetermined brightness degree due to the zero remainder (10→5=2 . . . 0)

Figure 2:
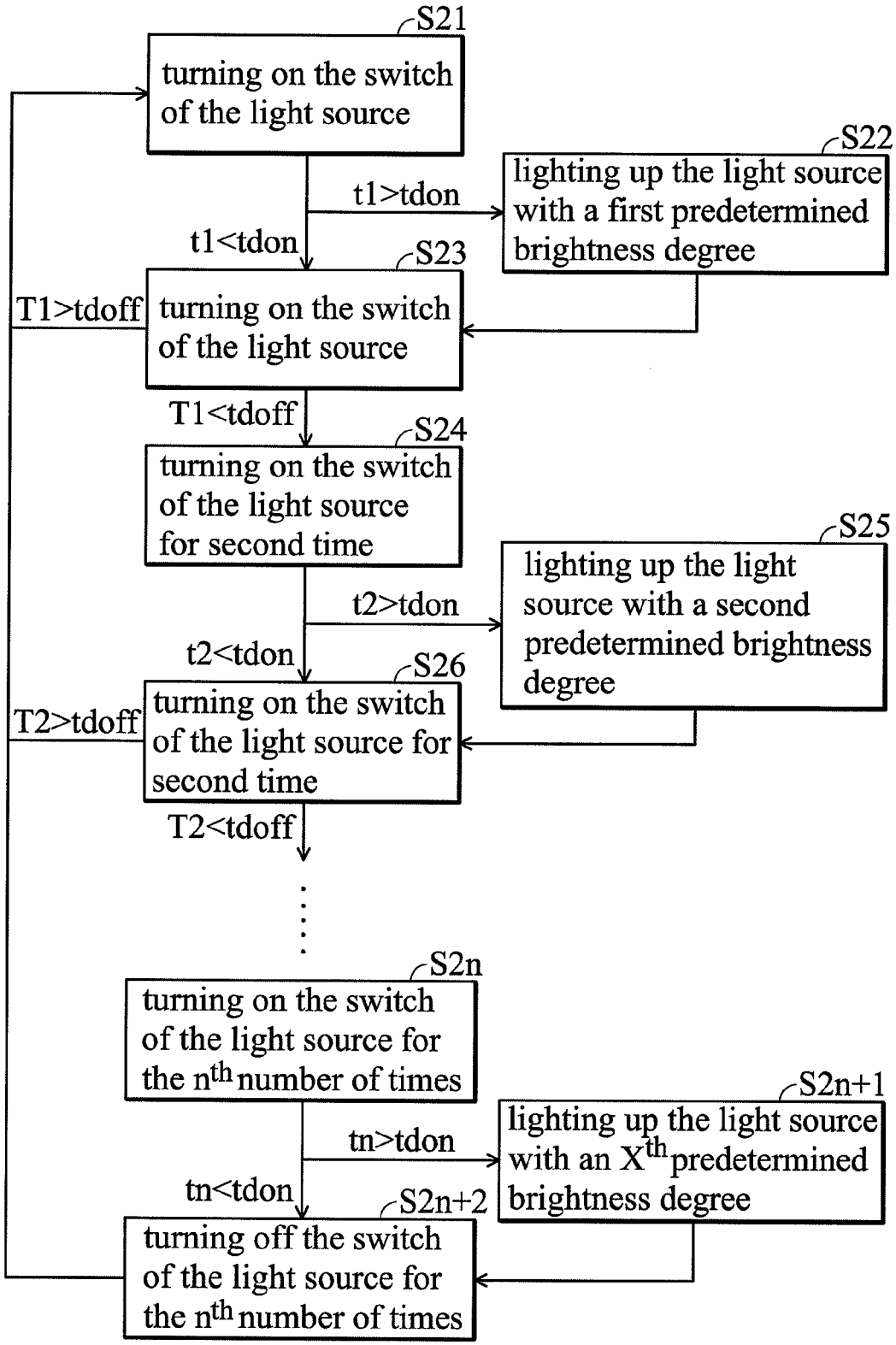
FIG. 2 is a flow chart of another exemplary embodiment of a method for adjusting brightness of a light source with a plurality of brightness degrees.

FIG. 2 is a flow chart of another exemplary embodiment of a method for adjusting brightness of a light source with a plurality of brightness degrees. The number of brightness degrees of the light source is represented by X. A switch of the light source is first turned on (step S21). The maintaining time period when the switch is turned on is t1, and a predetermined buffer time period tdon is defined. When the maintaining time period t1 is longer than the predetermined buffer time period tdon (t1>tdon), the light source is lit up with a first predetermined brightness (step S22). When the maintaining time period t1 is shorter than the predetermined buffer time period tdon (t1<tdon), the switch of the light source is turned off so that the light source can not be lit up. Note that it does not matter if the light source is lit up or not, the switch of the light source can always be turned off (step S23). After the switch of the light source is turned off, the time period T1 from the time point when the switch is turned off to the time point when the switch is turned on again is calculated. When the time period T1 is longer than the predetermined buffer time period tdoff, (i.e. a light source turned-on period) the method returns back to the step S21. That is, the method is refreshed, and it is again determined whether the maintaining time period t1 when the switch is turned on is longer than the predetermined buffer time period tdon, and it is determined whether the light source is lit up with the first predetermined brightness. When the time period T is shorter than the predetermined buffer time period tdon, the switch of the light source is turned on at the second time (step S24). When the maintaining time period t2 when the switch is turned on is longer than the predetermined buffer time period tdon, the light source is lit up with a second predetermined brightness (step S25) until the switch of the light source is turned off (step S26).

Following examples may be deduced, and the switch of the light source can be turned on for an $n^{th}$ number of times (step S2*n*). At this time, n is equal to the number X of brightness degrees. When the switch of the light source is turned on for an $n^{th}$ number of times (step S2*n*), if the maintaining time period tn when the switch is turned on is longer than the predetermined buffer time period tdon, the source light is lit up with an $X^{th}$ predetermined brightness degree (step S2*n*+1). If the switch of the light source is turned off for an $n^{th}$ number of times (step S2*n*+2) and then turned on for an $n+1^{th}$ number of times, there is no brightness degree for the $n+1^{th}$ number of times of turning on the switch of the light source because there are only X brightness degrees. In the case, the light source is lit with the first predetermined brightness degree. That is, the first predetermined brightness degree is determined for the $n+1^{th}$ number of times of turning on the switch of the light source.

According to the simple operations of turning on and off the switch of the light source, different brightness degrees are obtained to conform with different environmental conditions. When the light source is turned on, there is a delayed charging period, thereby avoiding flickering of the light source resulted from repeatedly turning on and off, which is uncomfortable to users. Moreover, inefficient power usage is prevented, thus extending utility lifespan of the light source.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for adjusting brightness of a light source, comprising:

providing a light source with X brightness degrees;

turning on and off the light source at least one time;

when the number n of times of turning on the light source is less than or equal to the total number X of brightness degrees, determining the brightness degree of the light source being the $n^{th}$ brightness degree among the X brightness degrees;

when the number n of times of turning on the light source is greater than the total number X of brightness degrees, determining the brightness degree of the light source being the $m^{th}$ brightness degree among the X brightness degrees, wherein the number m is equal to a remainder obtained by dividing the number n by the number X; and when the number n of times of turning on the light source is greater than the total number X of brightness degrees and the number m is equal to zero, determining the brightness degree of the light source being the last brightness degree among the X brightness degrees.

2. The method as claimed in claim 1, wherein the brightness degrees are sequentially from dark to bright or from bright to dark.

3. The method as claimed in claim 1, wherein when the light source is turned on and off at one time, the brightness of the light source is changed once.

4. The method as claimed in claim 1, wherein a time period from a time point when the light source is turned off to a time point when the light source is turned on has to be short than a predetermined time period, and if the time period is longer than the predetermined time period, the light source is lit up with an initial brightness degree which is equal to the first brightness degree among the X brightness degrees.

5. A method for adjusting brightness of a light source, comprising:

providing a light source with X brightness degrees;

turning on and off the light source at least one time;

when the number n of times of turning on the light source is less than or equal to the total number X of brightness degrees, determining the brightness degree of the light source being according to the $n^{th}$ brightness degree among the X brightness degrees;

when the number n of times of turning on the light source is greater than the total number X of brightness degrees, determining the brightness degree of the light source bring the $m^{th}$ brightness degree among the X brightness degrees, wherein the number m is equal to a remainder obtained by dividing the number n by the number X; and;

when the number n of times of turning on the light source is greater than the total number X of brightness degrees and the number m is equal to zero, determining the brightness degree of the light source being the last brightness degree among the X brightness degrees; and providing a buffer time period between a time point when the light source is turned on and a time point when the light source is lit up.

6. The method as claimed in claim 5, wherein the brightness degrees are sequentially from dark to bright or from bright to dark.

7. The method as claimed in claim 5, wherein when the light source is turned on and off at one time, the brightness of the light source is changed once.

8. The method as claimed in claim 5, wherein when a time period from a time point when the light source is turned off to a time point when the light source is turned on has to be shorter than a predetermined time period, and if the time period is longer than the predetermined time period, the light source is lit up with an initial brightness degree which is equal to the first brightness degree among the X brightness degrees.

9. The method as claimed in claim 5, wherein a maintaining time period when the light source is turned on has to be longer than the buffer time period, and if the maintaining time period is shorter than the buffer time period, the light source is not lit up.

* * * * *